United States Patent [19]

Hall

[11] 4,086,846

[45] May 2, 1978

[54] APPARATUS AND METHOD TO SENSE AND ADJUST THE RELATIVE POSITION OF HOLLOW TUBES WITHIN A CONTINUOUS FILTER

[75] Inventor: Floyd Vanmeda Hall, Durham, N.C.

[73] Assignee: Liggett Group Inc., Durham, N.C.

[21] Appl. No.: 782,398

[22] Filed: Mar. 29, 1977

[51] Int. Cl.[2] ..... A24C 5/50

[52] U.S. Cl. ..... 93/77 FT

[58] Field of Search ..... 93/77 FT, 1 C; 131/10.3, 10.5, 261 R, 261 B, 264, 10.7, 10.9

[56] References Cited

U.S. PATENT DOCUMENTS

| | | | |
|---|---|---|---|
| 3,259,029 | 7/1966 | Hall et al. | 93/1 C |
| 3,380,351 | 4/1968 | Cox et al. | 93/1 C |
| 4,037,524 | 7/1977 | Hall | 131/10.5 X |
| 4,043,454 | 8/1977 | Reuland | 93/77 FT X |

*Primary Examiner*—James F. Coan

*Attorney, Agent, or Firm*—J. Bowen Ross, Jr.; Michael L. Hendershot

[57] ABSTRACT

The sensing and correcting apparatus is employed in a machine for making cigarette filter rods containing hollow tubes on a continuous in line basis. The apparatus senses the position of the hollow tubes in a stream of tow and corrects the insertion position of subsequent hollow tubes if the position of the inserted tubes does not coincide with the proper cutting position. Sensing is accomplished by measuring the density of the moving stream and generating a position signal in response for comparison with a reference signal generated on cutting of a filter rod. If there is a difference exceeding acceptable tolerance limits, the comparison means generates a correction signal which is delivered to a timing assembly in the transmission for inserting the hollow tubes.

10 Claims, 5 Drawing Figures

APPARATUS AND METHOD TO SENSE AND ADJUST THE RELATIVE POSITION OF HOLLOW TUBES WITHIN A CONTINUOUS FILTER

BACKGROUND OF THE INVENTION

This invention relates to an apparatus and method for making filters for cigarettes. More particularly, this invention relates to an apparatus and method for making filters for cigarettes having a hollow tube embedded therein.

Heretofore, filter making machines have been known in which hollow tubes, for example of plastic, are inserted into a moving stream of fibrous filter material such as cellulose acetate (tow). In some cases, the hollow tube has been continuous with the tow such that the filters subsequently cut from resulting filter rods have a tube extending from end to end. In other cases, where a filter is to be made with a hollow tube extending only partially within the filter, machines have been known for inserting short hollow tubes into a moving stream of tow at spaced intervals. In these latter machines, the moving tube-containing stream must be cut through a tube containing section so as to sever the tube in half. If the tube is not severed in half, a short tube portion will be incorporated in one resultant filter and a long tube portion will be incorporated in a second resultant filter. In either case, the efficiency of the filter can be impaired. Also, if the tube portion becomes too long, the result may be a filter with a tube extending from end to end.

In order to overcome the problems associated with machines in which hollow tubes are inserted into a moving stream of tow, it has been known to provide the mechanism for inserting the tubes with a transmission which can be manually adjusted to advance or retard the point at which a tube is inserted into the two. However, since the filter making machine usually operates at high speed and since the detection of an improper placement of the tubes usually occurs after cutting of the filter rod, a large number of improperly made filters may be produced before an adjustment can be made.

Accordingly, it is an object of the invention to provide an apparatus and method for automatically sensing and correcting the position of hollow tubes inside a stream of tow.

It is another object of the invention to sense the position of hollow tubes in a stream of tow before the stream is cut into filter rods.

It is another object of the invention to detect an incorrect positioning of hollow tubes in a moving stream of tow and to automatically correct the position of subsequently inserted tubes in the tow stream.

It is another object of the invention to reduce the number of improperly made tube-containing filters in automatic machinery.

Briefly, the invention provides an apparatus for incorporation into a machine for making filter rods having tube-containing sections which is capable of sensing the position of the tubes and correcting the position of subsequently positioned tubes. The machine includes means for supplying a travelling stream of fibrous filter material (tow), means for inserting hollow tubes into the fibrous filter material and a knife for cutting the stream of hollow tube-containing fibrous filter material into filter rods. The sensing and correction apparatus includes a sensing means upstream of the knife for sensing the presence of a hollow tube in the stream of tow and for generating a position signal in response thereto and means for generating a constant reference signal in response to the knife cutting the stream. In addition, the apparatus has a comparison means for comparing the position signal with the reference signal and for generating a correction signal in response to a disparity between the position signal and reference signal. Also, the apparatus has a correction means for receiving the correction signal, if any, which correction means is connected to the tube inserting means of the machine so as to adjust the tube inserting means to correct the position at which a tube is inserted into the tow stream.

The sensing means can be in the form of a density gauge of known construction for measuring the density of the tube-containing stream over a period of time and for generating the position signal corresponding to this measurement. The means for generating the reference signal is actuated by the knife of the machine to emit the reference signal as a cut is made. If the position signal exceeds the value of the reference signal, the timing assembly advances the inserting means to insert subsequent tubes into the tow stream at an earlier time. If the position signal is less than the value of the reference signal, the timing assembly retards the inserting means to insert the tubes at a later time.

The position signal and reference signal may be of any suitable type. For example, each may represent a value which can be compared algebraically. Also, the signals may be compared with respect to time. In this case, the duration of the position signal relative to the duration of the reference signal may be compared. If the position signal is longer, then the inserting means is advanced and if shorter, the inserting means is retarded.

As the position signal is generated earlier than the reference signal, a time delay is built into the comparison means so that the two signals for a given filter rod can be compared.

The invention also provides a method to sense the position of hollow tubes within a moving stream of tow. The method comprises the steps of sensing the position of the tube within the tow and generating a position signal in response thereto; generating a reference signal indicative of the cutting of a filter rod from the stream; comparing the position signal to the reference signal and generating a correction signal in response to a disparity therebetween; and correcting the position of a hollow tube subsequently inserted in the tow in response to the correction signal.

These and other objects and advantages of the invention will become more apparent from the following detailed description and appended claims taken in conjunction with the accompanying drawings in which:

DESCRIPTION OF THE INVENTION

Figure 1:
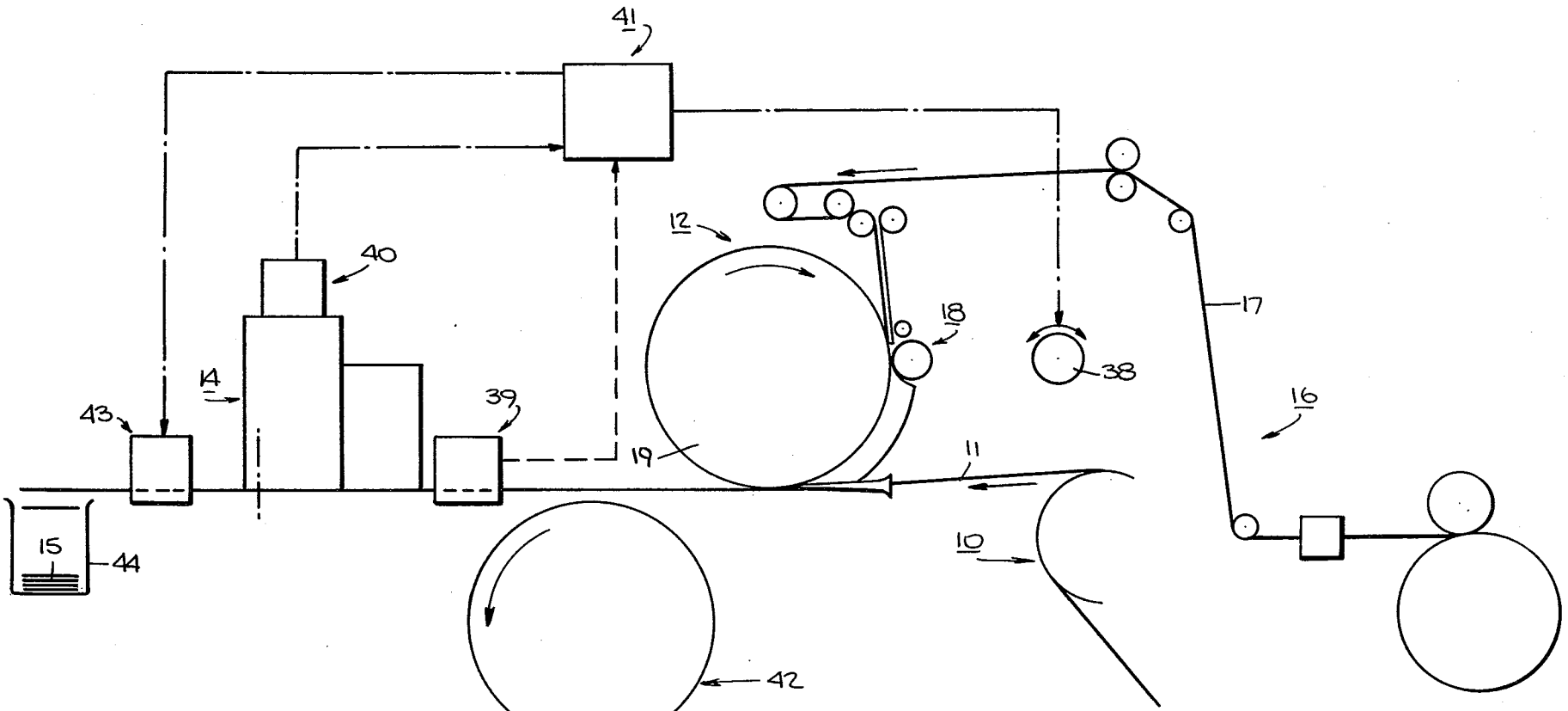
FIG. 1 illustrates a schematic view of a filter rod making machine employing a sensing and correcting apparatus according to the invention.

Referring to FIG. 1, the filter rod making machine is of generally known construction. Thus, only a description of those components necessary to the present invention will be described herein. As shown, the machine has a means 10 for supplying a travelling stream of fibrous filter material (tow) 11, means 12 for inserting hollow tubes 13 into the stream of tow 11 at an injection station and a knife 14 for cutting the tube-containing stream into filter rods 15, for example of a length to form six filter plugs. These severed rods 15 are referred to hereinafter as plug rods. The means 12 for inserting the hollow tubes 13 is similar to that described in copending U.S. patent application Ser. No. 740,030, filed Nov. 8, 1976. For example, this means 12 includes a means 16 for supplying a continuous length of hollow tubing 17, a cutting means 18 for cutting the continuous length of tubing 17 into short tubes 13, a wheel 19 for receiving and conveying the tubes 13 to the injection station and means (not shown) for inserting the tubes 13 at the injection station into the stream of tow 11 in spaced apart relation.

Figure 5:
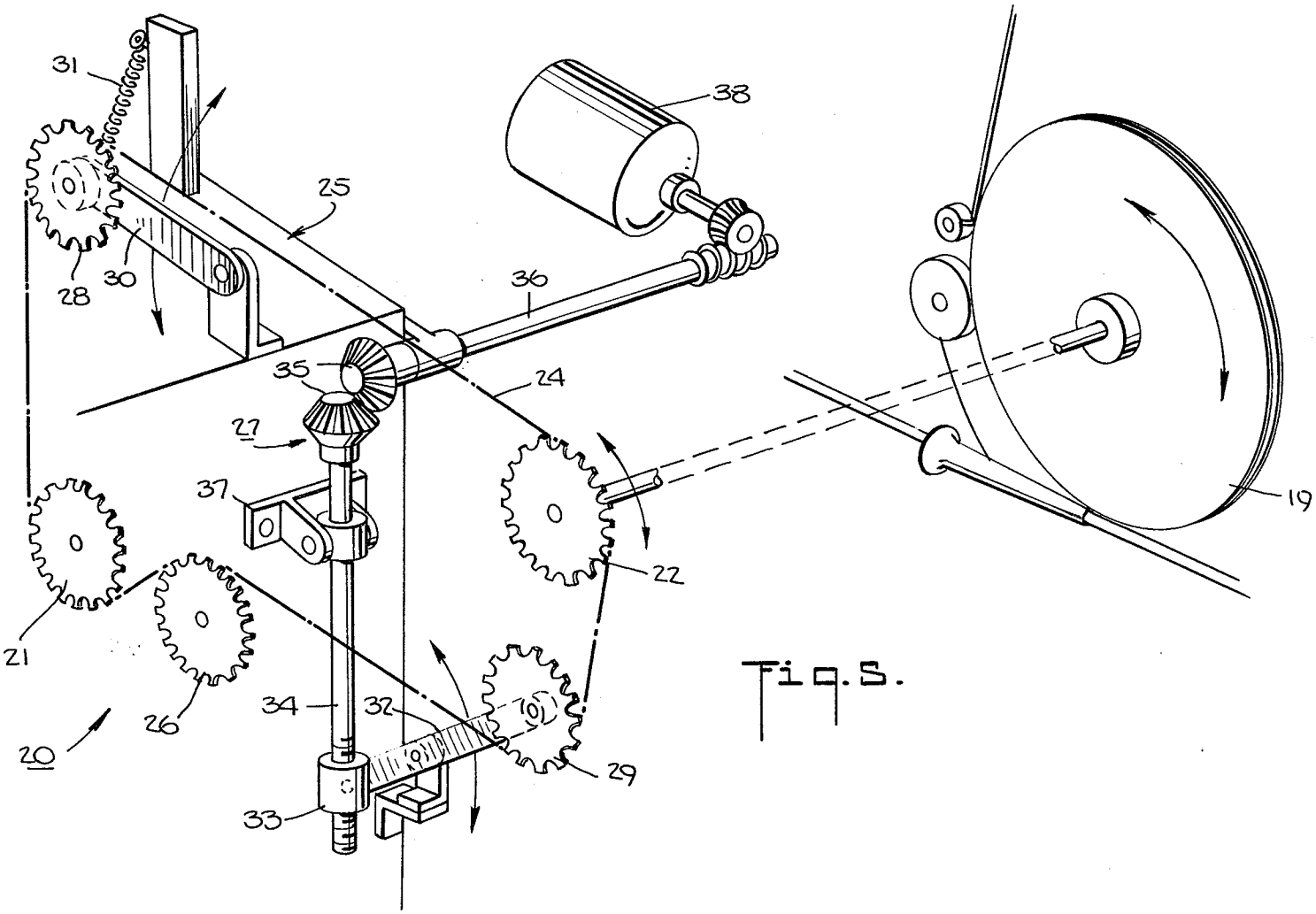
FIG. 5 illustrates a schematic of the transmission for the tube inserting means and the timing assembly in accordance with the invention.

Referring to FIG. 5, the filter rod making machine also has a transmission 20 for driving the wheel 19 off a drive means (not shown) of the machine. This transmission 20 has a rotatable power sprocket 21 which is connected to the drive means (not shown), a drive sprocket 22 fixedly connected to the wheel 19 via a shaft 23, and a chain 24 which is in meshing engagement with the sprockets 21, 22. The sprockets 21, 22 are mounted in a suitable frame 25 of the machine along with an idler sprocket 26 over which the chain 24 engages. In addition, a timing assembly 27 is connected to the transmission 20. This timing assembly 27 includes a pair of idler sprockets 28, 29 which mesh with the chain 24 and which are disposed on opposite sides of the drive and driven sprockets 21, 22. One idler sprocket 28 is rotatably mounted on an arm 30 which is pivotably mounted in the frame 24 and which is biased by a spring 31 away from the chain 24. The other idler sprocket 29 is rotatably mounted on an arm 32 which is pivotably mounted on the frame 24 at an intermediate point and which carries a threaded collar 33 at the opposite end. The timing assembly 27 also includes a right angle drive formed by a shaft 34 which is in threaded rotational engagement with the collar 33 and which is connected via bench gears 35 with a second shaft 36. The first shaft 34 is guided within a suitable bracket and collar assembly 37 which is mounted on the frame 24. The shaft 36 of the right angle drive forms a take-off shaft of a motor and gear assembly 38 which forms a correction means as described below. Should the shaft 36 turn, this causes the arm 32 to pivot. At this time, the chain 24 is either tightened so as to move the sprocket 28 from the spring 31 or slackens to allow the sprocket 28 to move toward the spring 31. These movements cause the chain 24 to turn the driven sprocket 22 and, thus, the wheel 19 and related mechanisms of the inserting means in one of two opposite directions so as to advance or retard the point at which a tube 13 is injected into the tow 11.

Referring to FIG. 1, the apparatus for sensing and correcting the position of the tubes 13 in the tow 11 includes a sensing means 39 upstream of the knife 14 for sensing the presence of a hollow tube 13 in the tow 11 and for generating a position signal A (FIG. 2) in response thereto. This sensing means 39 is in the form of a density gauge of known construction, e.g. a density gauge sold under the designation ACCURAY by Industrial Nucleonics, which measures the density of the tube-containing tow stream passing thereby. The apparatus also includes a means 40 for generating a constant reference signal B (FIG. 2) in response to a cut by the knife 14. This means 40 is in the form of a signal timing generator of known construction. Both the sensing means 39 and reference signal generating means 40 are connected via suitable lines to a comparison means 41 for comparing the signals A, B and for generating a correction signal in response to a disparity between the signals A, B. This comparison means 41 is in the form of a C-700 Accuray gauge and is connected to the motor 38 of the timing assembly 27 to deliver the correction signal, if any, thereto in order to rotate the shaft 36 (FIG. 5) in a clockwise or counter-clockwise direction. For example, if the correction signal be positive, the shaft 36 and thus the wheel 19 are advanced whereas if the correction signal be negative, the wheel is retarded.

Referring to FIG. 1, the machine employs a ribbon wheel 42 as is known to envelop the tube-containing tow stream in a strip of paper to form a continuous rod prior to passage by the sensing means 39.

The sensing and correcting apparatus also has a reject means 43 which receives a signal from the Accuray gauge 41 when a correction signal is emitted to the timing motor 38. This signal actuates the reject means 43 to reject the plug rod 15 containing the improperly positioned tube 13 before the rod 15 can drop into a catcher 44. For example, the reject means 43 may be of a type which ejects a blast of air against a defective plug rod 15 in order to blow the rod 15 away from the catcher 44 and into a reject bin. In this regard, it is noted that the presence of one inaccurately positioned tube 13 or the absence of a tube 13 where a tube 13 is required will cause the entire plug rod 15 to be rejected.

Referring to FIG. 1, in operation, a continuous length of tubing 17 is fed into the cutting means 18 and cut into small tubes 13, each 30 millimeters long for example. The tubes 13 are received on the wheel 19 and conveyed to the injection station where each is embedded, in turn, in the travelling stream of tow 11. The hollow tubes 13 are spaced apart in the tow 11 a distance of 20 millimeters. The tube containing tow is then wrapped with paper into a continuous tubular rod. The tubular rod is then moved at a constant rate past the density gauge 39.

Figure 2:
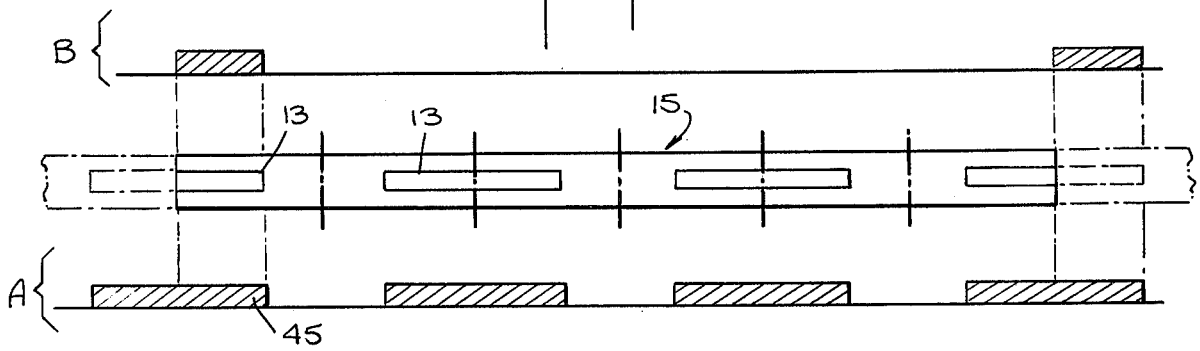
FIG. 2 illustrates a schematic of the signals generated from a filter rod containing properly positioned hollow tubes.

The density gauge 39 measures the density of the rod and thereby senses the relative position of the hollow tubes with the rod. Upon measuring the density of the rod, the density gauge 39 generates a signal A (FIG. 2). The signal A has a high density position 45 generated in an area corresponding to the presence of a hollow tube 13 and is proportional to the length of tube 13 and a low density portion elsewhere.

After passing through density gauge 39, the rod passes under the knife 14. The knife 14 then cuts the rod into 150 millimeter lengths while cutting a tube 13 in half. The resulting plug rod 15 has a 15 millimeter hollow tube on either end. In order to cut plug rods 15 having the proper length and placement of tubes 13, the hollow tubes 13 must be placed in the tow 11 within a tolerance of 1 millimeter.

When the knife 14 cuts off a plug rod 15, the generator 40 emits a reference signal B. The signal B, as shown in FIG. 2, corresponds to a high density reading corresponding to a 15 millimeter length of hollow tube 13.

This reference signal B is transmitted to the signal comparison means 41.

Figure 3:
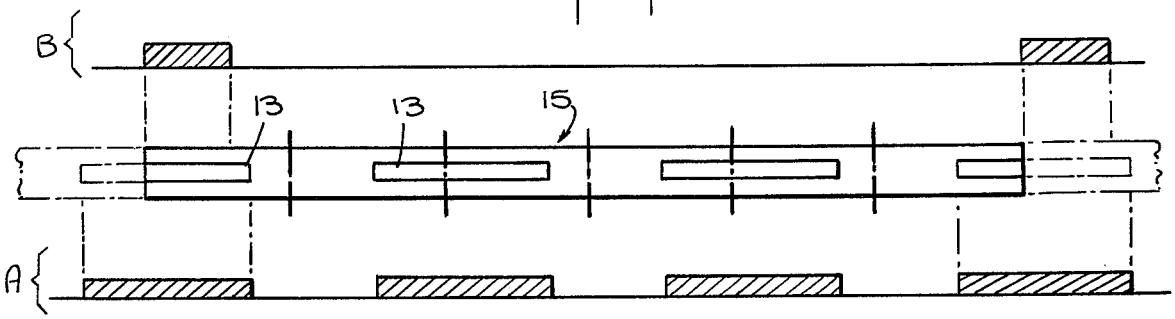
FIG. 3 illustrates a schematic of the signals generated from a filter rod containing improperly positioned hollow tubes.
Figure 4:
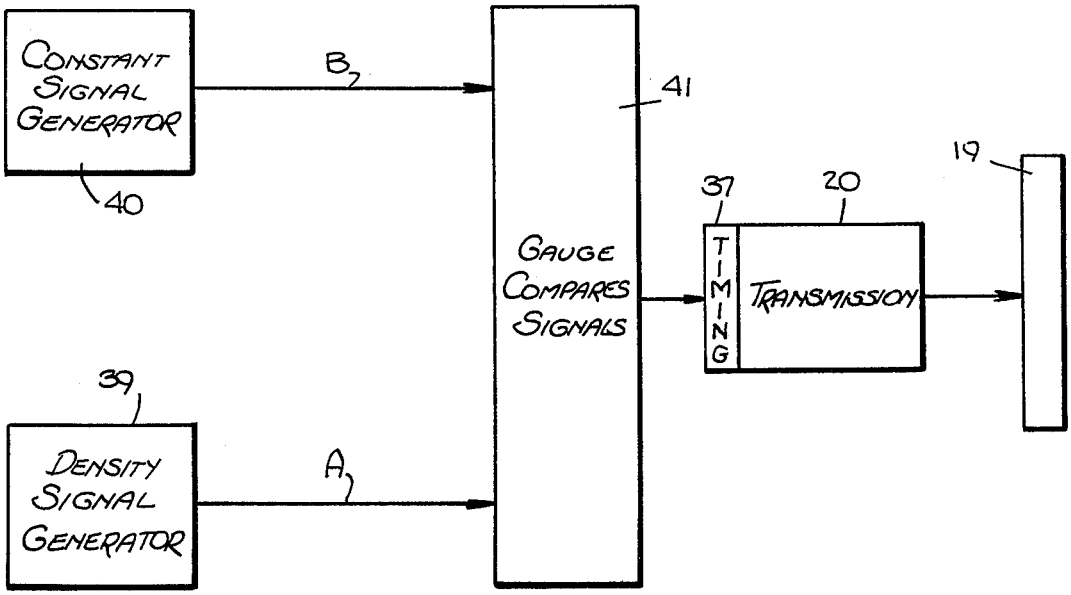
FIG. 4 illustrates a block diagram of the sensing and correcting apparatus according to the invention.

As shown in FIGS. 1 and 4, the signal comparison means 41 receives the constant reference signal B from the reference signal generator 40 and a signal A from density gauge 39. The reference signal generator 40 and the density gauge 39 are tuned so that when the hollow filter tubes 13 are properly positioned in the tube containing tow stream, the reference signal B will superimpose on the back half of the signal A such that there is alignment of the end of the reference signal B and the end of the position signal A (FIG. 2). Thus, no correction signal is emitted. If the position signal A is superimposed on the reference signal B such that the end of the position signal A is more than one millimeter from the end of the reference signal B (FIG. 3), a correction signal is generated and sent to the timing motor 38 to correct the position at which the hollow tubes 13 are inserted in the tow 11.

As the relative position of the hollow tubes 13 change, their new position is measured by the density gauge 39. This new position is compared with the constant reference signal B in the signal comparison means 41 and when the new position falls within the 1 millimeter tolerance, the correction signal terminates and the motor 38 stops turing.

Depending on the disparity between the signals A, B, the correction signal is either a positive or negative signal so as to actuate the timing motor in the proper direction to advance or retard the wheel 19.

Should a correction signal be generated, the reject means 43 is also activated to reject the defective filter rod before it can pass into the catcher 44.

The density measurements are taken across the whole cross-section of the travelling filter rod by the density gauge 39. Thus, an angular skewing of a tube 13 within the rod will not cause the generation of a correction signal or reject signal if the skewed tube 13 remains within the limits of the proper tube position in the rod.

The invention thus provides an apparatus which can be used to quickly detect misformed tube-containing filter rods and to correct the tube inserting means of the filter making machine almost instantaneously without loss of a significant number of filter rods. The sensing and correcting apparatus can easily be incorporated into existing machines so that the cost of installation is at a minimum.

What is claimed is:

1. In an apparatus for making filter rods containing hollow tubes the combination of means for supplying a travelling stream of fibrous filter material;

means for inserting hollow tubes into the stream of fibrous filter material in spaced relation;

means for cutting a filter rod from the tube-containing stream;

means for sensing the presence of a hollow tube in the stream of fibrous filter material and for generating a position signal in response thereto;

means for generating a reference signal in response to cutting of a filter rod;

comparison means for comparing said position signal and said reference signal and for generating a correction signal in response to a disparity between said position signal and said reference signal; and correction means for receiving said correction signal and connected to said means for inserting hollow tubes for adjusting said latter means to correct the position at which hollow tubes are inserted into the stream of fibrous filter material.

2. The combination as set forth in claim 1 wherein said means for inserting hollow tubes includes a wheel for receiving a sequence of spaced apart hollow tubes for injection at an injection station into the stream of tow and a transmission for driving said wheel, and wherein said correction means includes a timing motor and gear assembly connected to said transmission for selectively advancing and retarding the timing of said transmission to insert the hollow tubes into the stream of fibrous filter material.

3. In the apparatus as claimed in claim 2, wherein said transmission comprises a rotatable power sprocket adapted to be fixedly connected to a drive means, a drive sprocket fixedly connected to said wheel, and a drive chain meshed with said sprockets for transmitting a driving force from said power sprocket to said drive sprocket to rotate said wheel; and wherein said correction means further includes a first pivotally mounted arm, an idler sprocket rotatably mounted on said first arm in meshing engagement with said chain, a spring biasing said arm away from said chain, a second pivotably mounted arm, a second idler sprocket rotatably mounted on said second arm, a threaded collar mounted on said second arm, a rotatably mounted shaft threaded into said threaded collar and connected to said motor and gear assembly for rotation thereby to pivot said second idler sprocket to adjust said wheel to insert hollow tubes into the fibrous filter stream at a different relative position thereof.

4. In the apparatus as claimed in claim 1 wherein the means for sensing the position of a hollow tube senses the longitudinal density of the stream of fibrous filter.

5. In combination with a machine for making filter rods and having means for supplying a travelling stream of fibrous filter material, means for inserting hollow tubes into the stream of fibrous filter material, and a knife for cutting the stream of hollow tube-containing-fibrous filter material into filter rods, the combination of a sensing means upstream of said knife for sensing the presence of a hollow tube in the stream of fibrous filter material and for generating a position signal in response thereto;

means for generating a constant reference signal in response to said knife cutting the stream;

comparison means for comparing said position signal and said reference signal and for generating a correction signal in response to a disparity between said position signal and said reference signal; and correction means for receiving said correction signal and connecton to said means for inserting hollow tubes for adjusting said latter means to correct the position at which hollow tubes are inserted into the stream of fibrous filter material.

6. In combination means for supplying a stream of fibrous filter material;

a rotatable insert feed wheel for inserting hollow tubes in spaced apart relation into the stream of fibrous filter material;

a transmission for driving said wheel;

a timing motor and gear assembly connected to said transmission for selectively advancing and retarding the timing of said transmission to insert the hollow tubes into the fibrous filter stream;

a density gauge downstream of said wheel to sense the density of the tube-containing stream and to generate a position signal in response thereto containing portions indicative of the positions of the tubes in the tube-containing stream;

a knife downstream of said gauge for cutting the tube-containing stream at preset intervals into filter rods;

a signal timing generator for generating a constant reference signal in response to a cut; and comparison means connected to said gauge and said generator for receiving and comparing said reference signal and said position signal and for generating a correction signal in response to a disparity between said reference signal and said position signal, said comparison means being connected to said timing motor and gear assembly to deliver said correction signal thereto to actuate said assembly to selectively advance or retard the timing of said transmission.

7. The combination as set forth in claim 6 which further comprises a reject means downstream of said knife for rejecting a filter rod in response to the generation of said correction signal.

8. The combination as set forth in claim 6 wherein said reference signal represents a value equal to one-half a length of a hollow tube.

9. In a process for making cigarette filter rods containing spaced apart hollow tubes, wherein each rod is cut from a stream of fibrous filter material, a method for sensing and adjusting the position of a hollow tube in the stream of fibrous filter material comprising the steps of sensing the position of a hollow tube within the stream of fibrous filter material and generating a position signal in response thereto;

generating a reference signal indicative of the cutting of a rod from the stream;

comparing the position signal and the reference signal and generating a correction signal in response to a disparity therebetween; and correcting the position of a hollow tube being subsequently inserted in the stream of fibrous filter material in response to said correction signal.

10. The method as claimed in claim 9 wherein the step of sensing the relative position of a hollow tube comprises measuring the density of the fibrous filter stream.

* * * * *